US007428869B2

(12) United States Patent
Lutz

(10) Patent No.: US 7,428,869 B2
(45) Date of Patent: Sep. 30, 2008

(54) METHOD OF PRINTING GOLF BALLS WITH CONTROLLED INK VISCOSITY

(75) Inventor: Mitchell E. Lutz, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/739,294

(22) Filed: Dec. 19, 2003

(65) Prior Publication Data

US 2005/0132909 A1 Jun. 23, 2005

(51) Int. Cl.
*B41F 33/00* (2006.01)

(52) U.S. Cl. ..... 101/483; 101/DIG. 40; 382/141

(58) Field of Classification Search ..... 101/483, 101/DIG. 40; 382/141
See application file for complete search history.

(56) References Cited

U.S. PATENT DOCUMENTS

| | | | | | |
|---|---|---|---|---|---|
| 1,527,691 | A * | 2/1925 | McNab et al. | ..... | 101/5 |
| 1,814,312 | A * | 7/1931 | Heene | ..... | 400/118.1 |
| 1,921,571 | A * | 8/1933 | Jones | ..... | 400/128 |
| 3,435,666 | A * | 4/1969 | Fann | ..... | 73/54.32 |
| 3,733,633 | A * | 5/1973 | Gustafson | ..... | 15/21.2 |
| 4,175,425 | A * | 11/1979 | Brookfield | ..... | 73/54.28 |
| 4,362,179 | A * | 12/1982 | MacPhee et al. | ..... | 137/3 |
| 4,825,228 | A * | 4/1989 | Gloeckler et al. | ..... | 347/7 |
| 5,160,536 | A | 11/1992 | Harris et al. | ..... | 106/19 R |
| 5,632,205 | A | 5/1997 | Gordon et al. | ..... | 101/483 |
| 5,732,147 | A | 3/1998 | Tao | ..... | 382/110 |
| 5,885,173 | A * | 3/1999 | Keller | ..... | 473/385 |
| 5,960,098 | A | 9/1999 | Tao | ..... | 382/110 |
| 5,968,605 | A | 10/1999 | Lutz | ..... | 427/500 |
| 6,001,898 | A | 12/1999 | Lutz | ..... | 523/160 |
| 6,031,933 | A * | 2/2000 | Kumagai | ..... | 382/141 |
| 6,099,415 | A | 8/2000 | Lutz | ..... | 473/357 |
| 6,248,804 | B1 | 6/2001 | Lutz | ..... | 523/160 |
| 6,418,843 | B1 * | 7/2002 | Givler | ..... | 101/35 |
| 6,462,812 | B1 | 10/2002 | Heene et al. | ..... | 356/237.1 |
| 6,500,495 | B2 | 12/2002 | Lutz | ..... | 427/500 |
| 6,630,998 | B1 * | 10/2003 | Welchman et al. | ..... | 356/394 |
| 6,923,115 | B1 * | 8/2005 | Litscher et al. | ..... | 101/35 |
| 2001/0012389 | A1 * | 8/2001 | Welchman et al. | ..... | 382/141 |
| 2001/0042400 | A1 * | 11/2001 | Boyle et al. | ..... | 73/54.28 |
| 2002/0009553 | A1 * | 1/2002 | Lutz | ..... | 427/552 |
| 2002/0134257 | A1 * | 9/2002 | Stephenson | ..... | 101/35 |

* cited by examiner

*Primary Examiner*—Jill E. Culler
(74) *Attorney, Agent, or Firm*—Hanify & King, P.C.

(57) ABSTRACT

The present invention relates to a method printing indicia that includes dynamically controlling viscosity within a sealed cup assembly that is used in pad printing radiation curable inks on game balls. The present invention further relates to a method of removing radiation ink from an uncured inked golf ball surface.

22 Claims, 7 Drawing Sheets

Game Ball Printing Method

Game Ball Printing Method

METHOD OF PRINTING GOLF BALLS WITH CONTROLLED INK VISCOSITY

FIELD OF THE INVENTION

The present invention relates to a method of printing on golf balls. In particular, the method involves dynamically controlling viscosity within a sealed cup assembly that is used in pad printing radiation curable inks on game balls and optionally removing radiation curable ink from an uncured inked golf ball surface.

BACKGROUND OF THE INVENTION

It is often desirable to apply clear, pigmented or dyed ink coatings or layers to form distinctive logos or indicia on game balls (e.g., golf balls, ping pong balls, billiard balls, baseballs, basketballs, racquet balls, handballs, etc.). Various commercially available inks are commonly used for this purpose. More than five hundred million golf balls are produced each year, a significant percentage of which have indicia or logos printed on their outer surface. The indicia typically include any one of the golf ball company, tradename, a number, or an image, such as a corporate or country club logo. The most common method for adding a logo to the dimpled surface of a golf ball is by pad printing, although other methods, such as inkjet printing, are adaptable for such surfaces.

Golf balls are commonly one-piece, two-piece or three-piece constructions. One-piece balls are made from a homogeneous polymer shaped into a golf ball. Two-piece golf balls comprise a core and an outer surrounding polymeric cover. Three-piece (or more) golf balls comprise various combinations of a core (wound or unwound), one or more intermediate polymeric shells and an outer polymeric cover. The cover polymer used in two-piece and three-piece balls may, for example, be balata, an ionomeric polymer (e.g., SURLYN®) or a polyurethane.

Golf ball covers are commonly painted with a primer coat, which may be colored (e.g., white) or transparent. Alternately, the cover itself may contain a colorant. Typically, a tough, often glossy, topcoat is applied over the cover and/or the primer coat to form a protective outer seal on the golf ball. The topcoat may comprise, for example, a two-component urethane. The topcoat typically increases the shine (i.e., glossy appearance) and durability of the golf ball to enhance or brighten its appearance.

Most commonly, indicia, logos and production prints are applied to golf balls by a pad printing process and apparatus. Pad printing uses an etched image plate (i.e., a cliché) having a negative etching of the desired image. During pad printing, ink is applied to the image plate, thus filling the etched image. Excess ink is then scraped off of the image plate, leaving behind ink only within the etched image. A printing pad is then momentarily lowered and pressed onto the inked image plate to lift ink off of the etched ink filled cavity onto the printing pad. The ink so lifted defines the shape of the etched image. The inked pad is then momentarily lowered and pressed onto, for example, a golf ball, thereby releasing the ink from the pad to the golf ball. The ink released from the pad forms, on the spherical surface of the ball, an image corresponding to that of the etched cavity.

Printing pads are made from a resilient material, such as silicone rubber, which desirably picks up ink from the etched cavity of the image plate during lift-off and releases all of the ink lifted off when brought into contact with the article to be printed. Once the ink is deposited, it is cured, most commonly by a thermal curing process or by air drying (e.g., evaporation of solvent).

Many conventional golf ball printing processes include running UV curable inks in sealed cups without control of ink viscosity. The ink can thicken upon printing and become unusable and must be discarded. Solvent can be added manually, but thorough mixing is not possible without agitating the cup.

In addition, once inks are applied and if necessary, cured, all decorating methods are difficult to remove from the surface of the ball without further damaging the performance of the finished product. Golf balls that have defective logos from decaling or hot-stamping processes are further processed and made into "X-OUT" or practice balls. Nitrocellulose-based inks applied directly to ionomeric based golf ball covers can be removed via fine grit sandblasting, a method well known to the skilled artisan. All removal and further processing methods are not cost effective.

However, there remains a need for a method that monitors and adjusts ink viscosity during the printing process of golf balls. Such a method would reduce the amount of ink that becomes unusable.

SUMMARY OF THE INVENTION

The present invention encompasses a method of forming an inked image on a golf ball comprising the steps of providing at least one golf ball; transferring the golf ball to a print station, orienting the golf ball to receive one or more indicia, logo or production print, and placing at least one ink layer on at least a portion of a curved surface of the golf ball; transferring the golf ball having at least one ink layer of indicia, logo or production print to a vision inspection system; obtaining an image of the at least one ink layer and analyzing the image to determine whether it is within predetermined acceptable parameters; transferring the golf ball to an ink removal or recycling station after the analyzed image is determined to be in nonconformance with the predetermined acceptable parameters and removing the at least one ink layer of the nonconforming image or transferring the golf ball to a radiation curing station after the analyzed image is determined to be within the predetermined acceptable parameters followed by curing the at least one ink layer by exposing the golf ball to radiation.

In one embodiment, the at least one ink layer is cured by radiation selected from the group consisting of ultraviolet radiation, visible radiation, electron beam radiation and a combination thereof. In another embodiment, the at least one ink layer is subject a first irradiation in an amount sufficient to at least partially cure a portion thereof, and subjecting the at least one ink layer to a second irradiation in an amount sufficient to further cure the at least one ink layer.

In one embodiment, the first irradiation comprises electron beam radiation and the second irradiation comprises ultraviolet radiation, visible radiation, or a combination thereof. In another embodiment, the first irradiation comprises ultraviolet radiation, visible radiation, or a combination thereof and the second irradiation comprises electron beam radiation.

In another embodiment, the method further comprises the step of applying a second ink layer on at least the same or a different portion of the golf ball; and radiation curing the second ink layer. In yet another embodiment, the second ink layer is applied before the golf ball is transferred to the vision inspection system. The inked image can be a logo or production print.

In one embodiment, the radiation curing station is cooled by one or more dichroic reflectors or a cold mirrors; one or more cooling gases; or a combination thereof. In another embodiment, the golf ball and the at least one inked image of the nonconforming image is contacted with a cleaning agent and subjected to mechanical agitation to remove the at least one ink layer of the nonconforming image. Preferably, the ink removal or recycling station is a rotary drum washer. In another embodiment, the rotary drum washer is agitated and further comprises high impact nozzles that spray the golf ball with the cleaning agent. Preferably, the agitation is sonic agitation or mechanical agitation.

In one embodiment, ink is monitored with an ink viscosity monitoring system. Preferably, the monitoring of the ink viscosity comprises rotating an impeller in a sealed cup assembly, wherein the impeller is attached to a motor and the current or amperage of the motor is measured. In one embodiment, solenoid valve opens and to dose the cup assembly with a solvent optionally containing a viscosity-reducing component when the current or amperage exceeds a predetermined set point such that viscosity is decreased to adjust the ink to within predetermined viscosity ranges.

Typically, the golf ball is maneuvered to position the at least one ink layer within view of at least one camera in the vision inspection system, scanning and analyzing the at least one ink layer to determine whether the at least one ink layer is within the predetermined acceptable parameters. Thereafter, the at least one ink layer can be analyzed for pixel content and compared to a reference image. Preferably, the at least one ink layer is analyzed for placement within a predetermined area of the golf ball surface and compared to the placement of a reference image. In another preferred embodiment, the at least one ink layer is analyzed for color and image clarity and compared to a reference image.

In one embodiment, two or more golf balls are transferred to and conveyed through the curing station to simultaneously cure indicia on each ball. In another embodiment, the curing station comprises a single longitudinal radiation source, wherein the single longitudinal radiation source is positioned longitudinally and parallel to the direction of golf ball conveyance; the single longitudinal source emits radiation that is substantially perpendicular to the line of golf ball conveyance; and the ball has continuous contact with radiation from the single radiation source for at least a portion of path where the golf ball travels in the curing station. In yet another embodiment, the one or more indicia, logo or production print is placed on an equator of the ball.

DETAILED DESCRIPTION OF THE INVENTION

Figure 1:
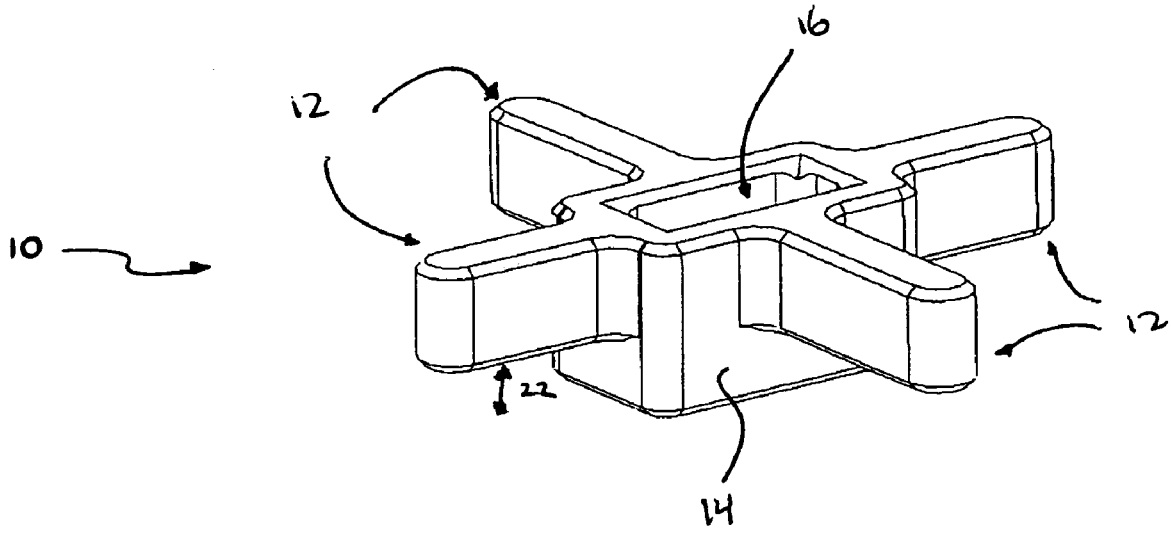
FIG. 1 is top angled view of an impeller having 4 blades.

The present invention encompasses a printing system comprising a print station having a sealed cup assembly with a dosing mechanism, an ink viscosity monitoring system, a vision system for inspecting balls and a radiation curing device for use to ensure print quality on printed surfaces, including golf balls. The printing system also may be used with other game balls, as well as on any surface that can be printed. The printing system is constructed and utilized to mark an identifying indicia, logo or production print on a curved surface, such as a ball, and more particularly a golf ball. Typically, the indicia, logo or production print indicates a company name and/or a brand name. Thus, it is important that the indicia, logo or production print is printed perfectly or near perfectly because the appearance of the indicia will be associated with the quality of the ball, and consequently, the quality of the company that produces the ball.

The printing system generally includes a printing station, an inline vision inspection station, a curing station and an ink removal/recycling station. The inline vision inspection station is positioned between the printing station and the curing station. Typically, the printing system additionally includes a ball source (e.g., a golf ball source) placed immediately before the printing station, as well as a conveyor line to move balls from one station of the printing system to another station of the printing system. Balls are transferred from the ball source by the conveyor line to the printing station for indicia printing, then the conveyor line transfers the balls to the inline vision inspection station.

The printing station optionally includes an apparatus for registration, i.e., the spatial orientation and manipulation, of a ball ("ball orienter") to position and orient the ball so that a particular surface area of the ball may be printed with a logo, production print or indicia. Typically, the ball orienter is an apparatus for the spatial orientation of a ball comprising a camera for gathering an image of the ball and its spatial orientation, a computer communicating with the camera for processing the image and for computing a required spatial rotation to bring the ball into the desired spatial orientation, and motors communicating with the computer for rotating the ball to a desired orientation without substantially moving the center of the ball. An example of a ball orienter is disclosed in U.S. Pat. No. 5,632,205, the entirety of which is incorporated by reference. Once the ball is oriented in its desired spatial orientation, the ball is printed with the desired indicia. In one embodiment, one or more indicia, logo or production print can be printed on the surface of a ball by a sequence involving orientation of the ball followed by printing of a first indicia, a second orientation of the ball followed by printing of a second indicia, and optionally subsequent orientation and printing of each subsequent indicia.

At the vision inspection system, the quality of the each indicia is determined for each printed ball. If the indicia on the ball is acceptable, then the conveyor line transfers the balls to the curing station. Unacceptable balls are rejected and transferred to an ink removal or recycling station to remove unacceptable indicia so that the ball may be properly reprinted. Thus, an unacceptable ball is reintroduced to the beginning of the printing system after the unacceptable indicia is removed.

In one embodiment, each golf ball is transferred from a golf ball source, which is typically a hopper or ball orienter, to a golf ball holder in the conveyor line. The conveyor line typically is composed of a plurality of golf ball holders that are positioned in a chain-like manner. The golf ball holders may be arranged in a single row or multiple parallel rows. The golf balls may be rotated by an engagement member or ball orienter while in the golf ball holder to position the indicia in a desired location of the golf ball, as well as allowing for indicia to be printed at multiple locations of the surface of the golf ball. The rotation is controlled and reproducible in order for indicia to be properly inspected in the vision inspection system. The golf balls may be any type of golf ball having a painted or unpainted cover.

Printing Station

The printing station is preferably a pad printing station. Pad printing utilizes an etched image plate (i.e., a cliche) having a negative etching of the desired image. The image plate, typically, is made of a tough material such as metal, steel, other alloy or photopolymer, which normally has a uniform thickness except for the area defining the negative etched image. The plate may optionally be coated with one or more protectant layers or materials, to enhance its useful life. Typically, the depth of the etched image is from about 5 microns to about 30 microns, or any value therebetween.

During pad printing, ink is applied to the image plate, thus filling the etched image. Excess ink is then scraped off of the image plate without a doctor blade, leaving behind a thin layer of ink only within the etched image. A printing pad is then momentarily lowered and pressed onto the inked image plate to lift ink off of the etched ink filled cavity onto the printing pad. The ink so lifted defines the shape of the etched image. The inked pad is then momentarily lowered and pressed onto, for example, a golf ball, thereby releasing the ink from the pad to the golf ball. The ink released from the pad forms, on the spherical surface of the ball, an image corresponding to that of the etched cavity.

This process of inking the image plate, scraping off excess ink, lifting off ink onto the printing pad and releasing the ink from the pad to the object (e.g., golf ball) to be inked may be repeated to print a plurality of images on a plurality of types of balls with various inks having desirable ink properties. The process of pad printing is well known. See, for example, U.S. Pat. No. 5,513,567 (Froh et al.); U.S. Pat. No. 4,896,598 (Leech, Jr.); U.S. Pat. No. 4,803,922 (Denesen); U.S. Pat. No. 4,745,857 (Putnam et al.); and U.S. Pat. No. 5,237,922 (Ho).

Printing pads typically are made from a resilient material such as silicone rubber and urethane-based materials and hybrids thereof, which desirably picks up ink from the etched cavity of the image plate during lift-off and releases all of the ink lifted off when brought into contact with the article to be printed. Once the ink is deposited, the golf ball is transferred to the vision inspection system to inspect the indicia.

As used herein, "production printing" is when ink is applied directly to the cover or to the primer coat and the ink is then further coated with a topcoat. The image produced thereby is a "production" print and the ink used for this purpose is a "production" ink. In production printing, for some applications, the cover surface is first roughened, for example, by sandblasting, vibratory finishing, corona, or plasma to enhance the bond between the ink and the cover, when ink is applied directly to a cover. Thereafter, the ink is applied to the roughened cover. A transparent water-based or solvent-based overcoat may be applied over the ink layer and on the roughened cover to smooth out the cover and ink surfaces. Examples of such overcoats known in the art include urethane, polyester and acrylic. Thereafter, a topcoat is preferably applied to the overcoat.

Alternatively, "logo printing" as also used herein, involves the application of the ink directly onto a topcoat. The image produced thereby is a "logo" and the ink is a logo (or custom) ink. Thus, by use of production and/or logo printing one may add decorative markings such as a company trademark, symbol or the like to increase brand recognition and/or to enhance the appearance and/or the visibility of golf balls, game balls and the like. Logo prints therefore adhere to the typically glassy exterior of a topcoat, and have no other protective coating affixed thereto.

Inks used in production and logo printing must have sufficient durability. Durability is influenced by such factors as ink layer flexibility (i.e., ink layer brittleness), ink layer resistance to abrasion, ink migration, ink layer hardness, adhesion to golf ball cover polymers such as ionomers (e.g., SURLYN®), balata, polyurethane, polyolefin and mixtures thereof, adhesion to topcoats, adhesion to primer coats and intercoat adhesion between various layers of inks and/or other overcoats and/or topcoats.

The inks utilized in the printing system are generally radiation curable inks. In particular, the inks may be cured by various means, including but not limited to UV radiation, visible radiation, and electron beam radiation. In addition, the inks utilized in the printing system may also be cured by heat (i.e., infrared radiation) or air dry. Radiation curable inks that may be utilized in the present invention are described in U.S. Pat. Nos. 5,968,605 and 6,500,495, each of which is incorporated by reference in its entirety.

As used herein, the term "radiation" refers to electromagnetic radiation having wavelengths in the ultraviolet and/or visible light regions of the spectrum, including electromagnetic radiation having a wavelength greater than about 400 nm. "Radiation curable," as used herein, refers to the ability to be cured with electromagnetic radiation having wavelengths in the UV and/or visible light regions of the spectrum and also by electron beam radiation.

In one embodiment, the radiation-curable inks are comprised of a prepolymer having at least two prepolymer functional moieties and a photoinitiator. The prepolymer is selected from the group consisting of a first acrylate, an ester, and mixtures thereof and at least one polymerizable monomer.

The first acrylates are acrylated prepolymers having high molecular weights, for example, of at least about 500 grams per mole and have at least 2 polymerizable functionalities (i.e., prepolymer moieties) per molecule of prepolymer. Typically, the acrylated prepolymers and the ester prepolymers have a high viscosity (e.g., 100-20,000 centipoise at 25° C.) and a molecular weight of between about 500 to about 5,000 grams per mole and between about 1 to 6 reactive prepolymer functional moieties per molecule. The ester may be an unsaturated ester.

The polymerizable monomers are considered reactive diluents. They may be monofunctional monomers or poly-functional monomers. These polymerizable monomers are used to modify (e.g., typically to reduce) the viscosity of the acrylate prepolymer or the ester prepolymer. However, these monomers also aid in the cross-linking of the prepolymers upon electron beam radiation curing thereof. These monomers include, but are not limited to, one or more monofunctional acrylates or one or more polyfunctional acrylates. For example, the monofunctional acrylates have one acryloyl or methacryloyl group per acrylate molecule whereas the polyfunctional acrylates have two or more acryloyl or methacryloyl groups per acrylate molecule.

Theoretically, upon exposure to UV and/or visible light it is conceivably possible to cure (i.e., polymerize) a polymerizable ink without a photoinitiator. In practice, however, a photoinitiator is required to achieve an economically feasible cure rate (i.e., increased cure rate). Increased cure rates yield higher production rates and lower per unit production costs of various inked articles such as game balls, golf balls and the like.

In addition, the ink base preferably includes visible light photoinitiator(s) (i.e., a photoinitiator having at least a part of its absorbance spectrum in the visible region or photoinitiator having its entire absorbance spectrum in the visible light region). These visible light photoinitiators can be used in conjunction with or as substitutes for UV photoinitiators. Preferably, a combination of UV and visible light photoinitiators are used. More preferably, the visible light photoinitiator(s) should have a substantial portion, i.e., greater than about 50 percent of its absorbance spectrum at wavelengths greater than about 400 nm. Even more preferably, the visible light photoinitiator should have a maximum absorbance at wavelengths greater than about 400 nm.

When a combination of UV and visible light photoinitiators or photoinitiators having an absorbance spectrum in both the UV and visible light regions are used in the ink, the ink is cured using UV and visible light. When only UV photoinitiators or only visible light photoinitiators having an absorbance spectrum primarily in the absorbance spectrum are used, then the ink may be cured using only UV or only visible light, respectively.

Visible light photoinitiators compatible with the ink base of the present invention (e.g., ink base for production ink or ink base for logo ink) include photoinitiators having at least a part of their absorbance spectrum in the visible region or photoinitiators having their entire absorbance spectrum in the visible light region. Preferably, the visible light photoinitiator (s) should have a substantial portion, i.e., greater than about 50 percent of its absorbance spectrum at wavelengths greater than about 400 nm. Even more preferable, the visible light photoinitiator should have a maximum absorbance at wavelengths greater than about 400 nm.

When a combination of UV and visible light photoinitiators or photoinitiators having an absorbance spectrum in both the UV and visible light regions are used in the ink, the ink is cured using UV and visible light. When only UV photoinitiators or only visible light photoinitiators having a peak absorbance in the respective spectral region are used, then the ink may be cured using only UV or only visible light, respectively.

The inks utilized in the printing system include production inks and logo inks. In particular, production inks includes an adhesion promoting component, which improves the adhesion of the production ink to, for example, a golf ball cover or primer coat when applied thereto and after being cured by radiation. The adhesion-promoting component also improves the adhesion of the ink to a topcoat (e.g., a urethane topcoat) or to an overcoat (e.g., a water-based urethane coat or solvent-based coat) when such coats are applied over the cured production ink.

The production ink may further comprise a viscosity-reducing component and/or a flexibility-promoting component. The viscosity-reducing component is any low molecular weight reactive diluent that reduces the viscosity of the production ink.

The flexibility-promoting component compatible with the present invention has a post-cure elastic modulus of between about 200 to about 60,000 pounds per square inch, a post-cure tensile strength of between about 50 to about 2,500 pounds per square inch and a post cure elongation of between about 5 percent to about 350 percent. Further, the flexibility-promoting component is any component that has a glass transition temperature (Tg) below about room temperature (e.g., below about 25° C.). The flexibility promoting component includes, but is not limited to, a second acrylate, a ring opening heterocycle, or mixtures thereof, wherein the ring opening heterocycle is selected from the group consisting of cyclic esters, cyclic lactones, cyclic sulphides, cyclic acetals, cyclic siloxanes and mixtures thereof. The second acrylate is selected from the group consisting of an aliphatic urethane acrylate, an aromatic urethane acrylate, a polyether acrylate, an acrylated amine, a polybutadiene acrylate, a melamine acrylate and mixtures thereof. The cyclic ester of the flexibility-promoting component includes an epoxide.

The logo ink of the invention differs from the production ink in that it contains different additive components due to differences in performance requirements of logos versus production prints. The logo ink comprises an ink base and at least a toughening agent. Toughening agents preferably are reactive diluents, which increase both the hardness and the flexibility of the ink base to yield a logo ink. Suitable toughening agents are sterically hindered acrylates, preferably, monomers, dimers, trimers or oligomers. Further examples of toughening agents compatible with the logo inks of the present invention include, but are not limited to, epoxy acrylate, isobornyl acrylate (SR-506), tetrahydrofurfuryl acrylate, cyclohexyl acrylate, dicyclopentenyl acrylate, dicyclopentenyl oxyethyl acrylate, vinyl toluene (styrene), isobornyl methacrylate, tetrahydrofurfuryl methacrylate, cyclohexyl methacrylate, dicyclopentenyl methacrylate, dicyclopentenyl oxyethyl methacrylate and mixtures thereof. The toughening agent is present typically from about 5-75% by weight, or any value therebetween, of the total weight of the logo ink, preferably, from about 5-30% by weight and, most preferably, from about 10-20% by weight.

A further, optional additive to the logo ink base is a friction-reducing agent commonly referred to as a slip and mar agent. The friction-reducing agent minimizes abrasion of the logo ink by sand, dirt and other abrasive materials or surfaces commonly encountered during golfing or during other typical uses of game balls. The friction-reducing agent decreases the friction between the logo (i.e., printed with the logo ink) and external abrasive materials on contact, thereby minimizing the degradation of the logo. Examples of friction-reducing agents compatible with the logo ink of the present invention include, but are not limited to, a solution of polyether modified dimethylpolysiloxane copolymer (BYK™-306; BYK™-341; BYK™-344), polyether modified dimethylpolysiloxane copolymer (BYK™-307; BYK™-333), a solution of acrylic functional, polyester modified dimethylpolysiloxane (BYK™-371), silicon acrylates, fluoropolymers (including partially fluorinated polymers and perfluoropolymers) and mixtures thereof. Examples of fluoropolymers include, but are not limited to fluoroacrylates, fluorinated polyalkylenes, fluorinated polyurethanes, fluorinated polyvinylidenes, and mixtures and copolymers thereof. Of these, the reactive friction reducing agents such as silicon acrylates and acrylic functional, polyester modified dimethylpolysiloxanes (BYK™-371) are preferred because they form bonds and become integrated into the structure of the logo ink upon curing. The BYK™ friction reducing agents are listed in the BYK product catalogue and may be obtained from BYK-Chemie USA of Wallingford, Conn. The friction reducing agents (e.g., dimethylpolysiloxanes) can be obtained from various companies such as Dow Coming (Midland, Mich.) and OSI Specialties (Endicott, N.Y.). The friction reducing agent is present in an amount of about 10% by weight (of the total weight of the logo ink) or less, typically, from about 0.1-10% by weight or any value therebetween, preferably, from about 0.6-4% by weight and, most preferably, from about 1-2% by weight.

For logos, the same ink base as described for the production inks is used, i.e., comprising a prepolymer having at least two prepolymer functional moieties, wherein the prepolymer is a first acrylate, an ester or mixtures thereof and a polymerizable monomer. Further, the ink base contains a photoinitiator. The photoinitiators compatible with logo inks are the same as those compatible (as previously listed) with production inks. Further, the percent by weight amounts of the photoinitiators compatible with production inks are also compatible with logo inks. Preferably, the visible light photoinitiator should have a substantial portion, i.e., greater than about 50 percent of its absorbance spectrum at wavelengths greater than about 400 nm. Even more preferable, the visible light photoinitiator should have a maximum absorbance at wavelengths greater than about 400 nm. Such visible light photoinitiators are generally combined with one or more ultraviolet light photoinitiators (such as those described earlier) to promote complete cure of the ink.

The single printing system includes an ink viscosity monitoring system. Generally, the ink viscosity monitoring system is located in the printing system and periodically or continuously measures ink viscosity. When the ink viscosity is found to be outside predetermined limits, the viscosity monitoring system automatically adjusts the viscosity so that the ink is brought back within the acceptable predetermined limits.

The inks are loaded into a sealed cup assembly that contains an impeller that rotates in the ink. As used herein, the term "impeller" refers to a rotating device that forces fluid to move in a desired direction or manner. A motor is connected to the impeller and the current or amperage to the motor is monitored while the motor operates at a constant velocity. Higher viscosity inks require higher current or amperage to the motor in order to rotate the impeller at a preset rate. Likewise, lower viscosity inks require lower current or amperage to the motor in order to rotate the impeller at a preset rate. If the current or amperage exceeds a predetermined set point (viscosity is higher than predetermined viscosity limits) a solenoid valve is opened and solvent and/or at least one viscosity-reducing agent is dosed to the cup, thereby lowering the viscosity of the ink and the load on the motor. Likewise, if the current or amperage drops below a predetermined set point (viscosity is lower than predetermined viscosity limits) a solenoid valve is opened and solvent containing at least one viscosity-increasing agent is dosed to the cup, thereby increasing the viscosity of the ink and the load on the motor.

The impeller can be any shape. For example, the impeller can have one or more blades, preferably placed in a symmetrical configuration. Each blade originates from the center of the impeller, or from a central body, and extends outwardly from the center. The central body may be any shape, including, but not limited to, a square, a rectangle, a diamond or any other polygonal shape, as well as a circle or oval shape. The central body may be completely solid or contain a bored-out hole of any shape. In one embodiment, the impeller comprises between 1 blade and 10 blades. Preferably, the blades are arranged in a symmetrical manner. For example, each blade of a 4-blade impeller is positioned at a 90-degree angle from the adjacent blades. In another example, each blade of a 6-blade impeller is positioned 60 degrees from the adjacent blades. The blades may have a straight and flat surface (See FIGS. 1-3); a curved surface (See FIG. 5*a*); or an angled surface (i.e., the blade me be bent; See FIG. 5*b*). The impeller also may have a coil shape, a rod shape, or disk shape.

Referring to the Figures, FIG. 1 shows a 4-blade impeller 10. Each blade 12 is connected to a rectangular body 14 that is bored out in the middle with a rectangular hole or opening 16. Each blade 12 is positioned at a 90-degree angle from the adjacent blades. The blades 12 do not extend down the full depth of the rectangular body 14 such that when the impeller 10 sits on a surface, there is a gap or clearance 22 between the bottom of each blade 12 and the surface of the blades 20. The gap or clearance 20 ensures that the blades 12 do not rotate within a boundary layer, which avoids excessive shear forces that may affect viscosity measurements. Thus, the blades 12 do not make contact with the boundary layer, particularly when the impeller is rotating.

Figure 2:
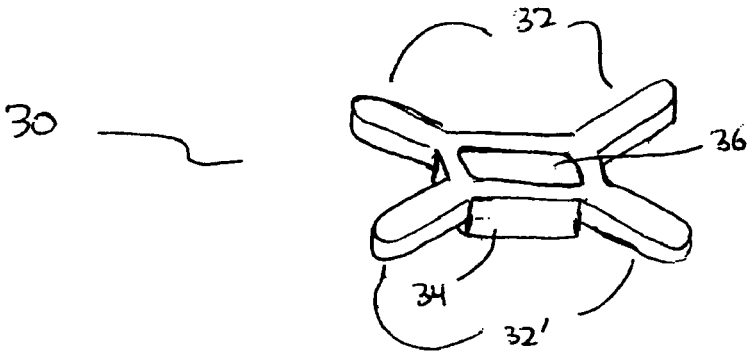
FIG. 2 is a top angled view of an impeller having different angles between sets of adjacent blades.

In another embodiment, the angles may be the same or different between sets of adjacent blades. An impeller where each set of adjacent blades are positioned having the same angle between them is described above, i.e., 4 blade impeller having 90-degree angles between adjacent blades. An example of an impeller having different angles between sets of adjacent blades is shown in FIG. 2, where a 4-blade impeller 30 having blades 32 and 32' is connected to a rectangular body 34 that is bored out in the middle with a rectangular hole or opening 36. Each blade 32 is positioned having a 150-degree angle between them. Similarly, each blade 32' are positioned having a 150-degree angle between them. Adjacent blades 32 and 32' are positioned having a 30-degree angle between them.

Figure 3A:
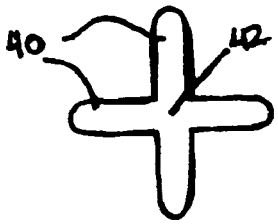
FIGS. 3*a*, 3*b* and 3*c* are a top view, side view and side angle view respectively of an impeller having four blades connected at a center.
Figure 3B:
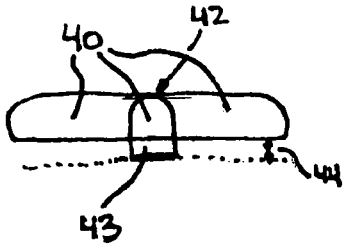
Figure 3C:
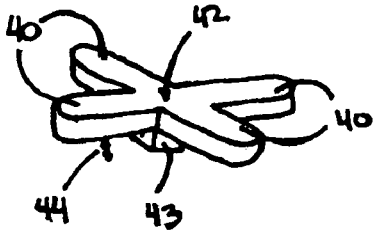

In another embodiment, the blades are connected at a common point as shown in FIGS. 3*a*, 3*b* and 3*c*, rather than to a central body member such as the one 14 described in FIG. 1. FIG. 3*a* is a top view of an impeller having four blades 40 that have a 90-degree angle between adjacent blades, each blade connected to the center 42 of the impeller. FIG. 3*b* is a side view and FIG. 3*c* is a side angle view of the impeller showing a protrusion at the bottom center of the impeller 43, and a gap 44 exists when the impeller sits on a surface. The gap 44 is sufficient such that the blades of the impeller do not make contact with the boundary layer, particularly when the impeller is rotating. In yet another embodiment, the impeller comprises one or more blades, similar to the impeller of FIGS. 3*a*-3*c*, except there is no protrusion at the bottom center of the impeller. Thus, the present invention encompasses an impeller that is positioned such that the entire impeller makes no contact with the boundary layer.

Figure 4A:
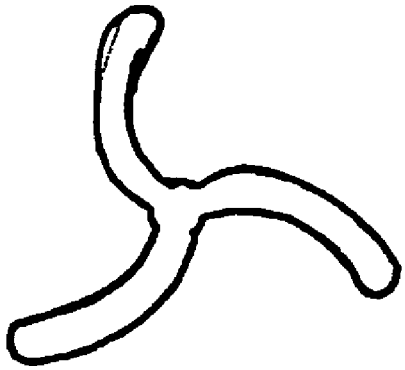
FIGS. 4*a* and 4*b* are impellers having curved blades and angled blades respectively.
Figure 4B:
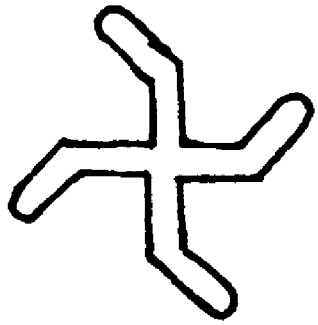

In yet another embodiment, the blades of the impeller may have any shape. For example, the blades of the impeller may be curved (See FIG. 4*a*) or bent or angled (See FIG. 4*b*). Further, the blades of the impeller may also have a smooth surface or a textured surface.

In one embodiment, the impeller resides outside the boundary layer of the sealed cup or plate assembly. The boundary layer typically exists between the impeller blade and plate or surface of the sealed-cup, i.e., the gap between the impeller blade and surface of the plate or sealed cup. In viscous flows, adjacent layers of fluid transmit both normal forces and tangential shear forces, as a result of relative motion between the layers. There is no relative motion, however, between the fluid and a solid boundary along which it flows. The fluid velocity varies from zero at the boundary to a maximum or free stream value some distance away from it. This region of retarded flow is called the boundary layer. The velocity gradient at the boundary, as well as the shear stress, decreases as the flow progresses downstream. Accordingly, positioning the impeller so that it rotates beyond the boundary layer, i.e., no portion of the impeller is within the immediate boundary layer, will allow for accurate viscosity measurements and better mixing. Such positioning of the impeller avoids inaccurate viscosity readings because factors other than viscosity contribute to the current or amperage load on the motor. In particular, rotation of an impeller within the immediate boundary layer will expose the impeller to shear forces. Shear is dependent on the molecular weight of inks. Thus, higher molecular weight inks, including inks with molecular weights of a thousand or more, are more difficult to shear and affect viscosity measurements for an impeller that is not positioned to avoid such shearing forces.

In one embodiment, there is a gap between the blades of the impeller and the surface of the printing plate. Preferably, the gap covers the entire boundary layer such that the blades of the impeller do not touch the boundary layer when rotating.

In another embodiment, there is a gap between the entire impeller and the wall of the sealed cup assembly that allows for proper measurement of viscosity without adversely affecting mixing of the ink. In another embodiment, the edge of the blades, or the edge of the entire impeller, resides right at the edge of the boundary layer. In yet another embodiment, the edge of the impeller resides between about 0.1 mm to about 20 mm from the cup edge.

In one embodiment, the viscosity is adjusted by addition of a solvent. Examples of solvents compatible with the present invention include, but are not limited to, (Fast Evaporating Rate Solvents): acetone, ethylacetate (85-88%), ethyl acetate (95-98%), ethyl acetate (99%), methyl acetate (80%), methyl ethyl ketone, iso-propyl acetate (95-97%), iso-propylether, tetrahydrofuran; (Medium Evaporating Rate Solvents): isobutyl acetate (90%), n-butyl acetate (90-92%), n-butyl acetate (99%), sec-butyl acetate (90%), sec-butyl alcohol, tert-butyl alcohol, 1,1,1-trichloroethane, ethyl ketone, ethyl alcohol 200 proof ANHD, ethyl alcohol 190 proof ANHYD, ethyl alcohol 190 proof (95%), methyl alcohol, methyl iso-butyl ketone, methyl iso-propyl ketone, methyl n-propyl ketone, 2-nitropropane, n-propyl acetate (90-92%), iso-propyl alcohol, n-propyl alcohol; (Slow Evaporating Rate Solvents): amyl acetate (ex Fuel Oil) (85-88%), amyl acetate primary (mixed isomers)(95%), amyl alcohol primary (mixed isomers), tert-amyl alcohol, iso-butyl alcohol, n-butyl alcohol, butyl dioxitol glycol ether, butyl oxitol glycol ether, m-cresol, cyclohexanol, cyclohexanone, diacetone alcohol, dibasic ester, diethylene glycol, diethylene glycol monobutyl ether acetate (95%), diisobutyl ketone, dimethyl formamide, diethylene glycol, monomethyl ether-low gravity, diethylene glycol monomethyl ether-high gravity, dipropylene glycol monomethyl ether, dipropylene glycol monomethyl ether acetate, ethyl butyl ketone, ethyl-3-ethoxy propionate, ethylene glycol, 2-ethyl hexanol, 2-ethyl hexyl acetate (95%), ethylene glycol monomethyl ether acetate (95%), ethylene glycol monomethyl ether acetate (99%), ethylene glycol monobutyl ether acetate, hexylene glycol, isobutyl isobutyrate, isophorone, methyl n-amyl ketone, diethyl glycol monomethyl ether, methyl isoamyl ketone, methyl isobutyl carbinol, ethylene glycol monomethyl ether, n-methyl-2-pyrrolidone, ethylene glycol monomethyl ether, propylene glycol, propylene glycol monomethyl ether, propylene glycol monomethyl ether acetate, propylene glycol mono tertiary butyl either, triethylene glycol; (Aliphatic Hydrocarbon Solvents): mineral spirits, naphtha, or mixtures thereof and (Aromatic Hydrocarbon Solvents): toluene, xylene or mixtures thereof. These solvents may be obtained from the Shell Chemical Company, Exxon (Houston, Tex.) or Eastman Chemical Co., (Kingsport, Tenn.). Additional solvents well known in the art may be used.

Once the ink or inks are applied onto the surface of the ball and any solvents optionally removed by flashing (e.g., with infrared heat, or held at ambient or room temperature for 20-30 minutes or heated by forced hot air to a ball surface temperature of about 120° F. or less for about 8-60 seconds), the balls are passed through a vision inspection system prior to curing. The balls either pass the vision inspection and are transferred to a curing station or they are rejected and are transferred to an ink removal/recycling station.

In the case of logo inks, the ink is first deposited, in one embodiment, on a golf ball topcoat and the solvent is then optionally removed by flash removal prior to the vision inspection and curing or recycling steps. In another embodiment, the logo ink is deposited before the top coat is applied.

In contrast, the production ink layer is first deposited directly upon the cover surface or primer coat, the solvent is optionally removed by flashing prior to the vision inspection and curing or recycling steps. Finally, overcoats and/or topcoats are applied to the radiation cured ink layer.

The vision inspection system comprises one or more cameras mounted above each conveyor line that convey the balls. In one embodiment, there is at least two (2) cameras mounted above each line of conveyance to inspect each indicia that is printed on each ball. Preferably, each camera is a CCD camera.

In one embodiment, the vision inspection system for inspecting balls is placed immediately after the printing station. In another embodiment, the vision inspection system is placed immediately before at least one of a radiation curing device and an ink removal station. Examples of suitable visual inspection systems are disclosed in co-pending U.S. patent application Ser. No. 09/372,881, filed Aug. 12, 1999, entitled "Apparatus and Method For Automated Game Ball Inspection," the disclosure of which is incorporated by reference in its entirety. The automated visual inspection system is provided in one or more golf ball processing stations, such as a printing station for indicia, in an assembly line and may be used to determine conformity of indicia to predetermined standards. In addition, utilizing an automated visual inspection system allows monitoring of 100% of the printed golf balls, in-line with the printing station, so that early signs of undesirable printing conditions can be attended.

The automated inspection system comprises and imaging system that is adapted to account for unique surface properties, such as contours and dimples, of a golf ball to analyze various characteristics of indicia (e.g., contouring or coloring) on a golf ball surface. In one embodiment, the automated vision inspection system is used to detect and analyze indicia, including its cosmetic or aesthetic appearance on the golf ball. For example, the distribution (e.g., uniformity and symmetry), adequacy (e.g., degree, thickness or quantity), and accuracy (e.g., the specific form of the printed indicia) with which indicia is applied. to the surface of a golf ball may be viewed by the automated vision inspection system. The automated visual inspection system transmits a clear, undistorted image of the ball being inspected to an analyzer that inspects various characteristics of the indicia which is applied to the golf ball surface.

The automated visual inspection system preferably includes an environmental modification device that provides a complete presentation of the game ball to the imaging system. For example, the environmental modification device can be the lighting modified to account for surface distortions caused by the unique spherical, dimpled exterior surface of the golf ball that permits two-dimensional analysis of the three-dimensional surface.

The automated visual inspection system provides a detection signal to an analyzer. The analyzer compares the detection signal with a predetermined standard signal in order to evaluate whether the printing of indicia on the golf ball meets predetermined quality standards.

Preferably, the analyzer generates a control signal depending on the results of the analysis of the indicia being detected. The control signal is used to remove defective products from the process. If a defective product is detected, the automated visual inspection system also may emit a warning signal so that either operator can attend to the cause of the defect immediately or the ball is automatically removed from the processing line after the defective product has been processed and inspected.

Utilizing an automated visual inspection system permits processed golf balls to be transferred automatically, thereby minimizing ball-to-ball and ball-to-surface contact which otherwise occurs during transfer. In one embodiment, the indicia processing is linked to a plurality of golf ball processing stations such that golf balls are transferred automatically from station to station. The application of the automated visual inspection system permits automated inspection without requiring human intervention.

Also in accordance with the principles of the present invention, a curing apparatus required to cure the indicia applied to the golf ball may be formed as a part of the automated printing station. In such a combined processing station, an automated visual inspection system preferably is provided between the print station and the curing apparatus such that inspection occurs as the balls are automatically passed from one to the next. Thus, defects are detected in advance of the completion of the curing process.

Once golf balls having defects are identified, they are rejected, excluded from curing and transferred to an ink removal or recycling station that removes the uncured UV ink from the golf ball. Golf balls that do not have defects are transferred to the radiation curing device so that the ink can be permanently cured onto the golf ball surface.

Once the ink or inks are applied onto a golf ball and the indicia are free of defects, the golf balls are cured by passing the golf ball through a radiation curing device. The radiation curing device contains at least one radiation source that can cure curable inks. Radiation sources include, but are not limited to, UV radiation, visible radiation and electron beam radiation and may be administered in any combination and in any order. A single radiation source also may be applied to sufficiently cure the ink or inks. Thus in one embodiment, the radiation curing device contains a single radiation source selected from the group consisting of UV radiation, visible radiation and electron beam radiation. In another embodiment, the radiation curing device contains two or more radiation sources, e.g., a UV radiation source and a visible radiation source; a visible radiation source and an electron beam radiation source; a UV radiation source and an electron beam radiation source; or a UV radiation source, a visible radiation source and an electron beam radiation source. Examples of irradiation techniques to cure inks are described in U.S. Pat. Nos. 6,500,495; 6,099,415; 6,013,330; and 6,001,898, the entirety of which are incorporated herein by reference.

The radiation may be applied concurrently or sequentially in any order. In one embodiment, the ink or inks are cured by irradiation with UV radiation, followed by irradiation with electron beam radiation. In another embodiment, the ink or inks are cured by irradiation with UV radiation and electron beam radiation concurrently.

In one embodiment, the ink or inks are cured by irradiation with visible radiation followed by irradiation with electron beam radiation. In another embodiment, the ink or inks are cured by irradiation with visible radiation and electron beam radiation concurrently.

In yet another embodiment, the radiation for curing the ink or inks can be produced from a single source that emits both UV and visible radiation, or from a separate UV radiation source and a separate visible radiation source, simultaneously or in series. In another embodiment, the radiation for curing the ink or inks can be produced from concurrent radiation from a single UV and visible light source and an electron beam radiation source. In yet another embodiment, the radiation for curing the ink or inks can be produced from concurrent radiation from a separate UV radiation source, a separate visible radiation source, and an electron beam radiation source.

Ultraviolet radiation sources are well known to those skilled in the art. See, for example, U.S. Pat. No. 4,501,993 (Mueller et al.), U.S. Pat. No. 4,887,008 (Wood), U.S. Pat. No. 4,859,906 (Ury et al.); U.S. Pat. No. 4,485,332 (Ury et al.), U.S. Pat. No. 4,313,969 (Matthews et al.), U.S. Pat. No. 5,300,331 (Schaeffer), U.S. Pat. No. 3,872,349 (Spero et al.), U.S. Pat. No. 4,042,850 (Ury et al.), U.S. Pat. No. 4,507,587 (Wood et al.), U.S. Pat. No. 5,440,137 (Sowers), U.S. Pat. No. 3,983,039 (Eastlund) and U.S. Pat. No. 4,208,587 (Eastlund et al.), each incorporated herein by reference in its entirety.

Preferred UV radiation sources include high intensity and high voltage UV sources. In particular, high intensity and high voltage UV sources include, but are not limited to, mercury lamps (including mercury/inert gas lamps), metal halide lamps, arc lamps, printed circuit lamps, capillary lamps, and iron or cobalt lamps. Particular examples of mercury lamps include medium-pressure mercury arc lamps, high-pressure mercury arc lamps, and microwave-powered mercury lamps. High pressure mercury arc lamps typically are constructed as a capillary-type tube and requires a fluid-filled jacket (e.g., water jacket) to maintain correct running temperatures. Microwave-powered mercury lamps generate arcs through the formation of microwaves and generally require magnetrons placed at each end of the lamp. Medium-pressure mercury arc lamps ("MPMA") generally have a hermetically sealed tube of UV transmitting vitreous silica or quartz with electrodes at both ends. The tube is filled with a small amount of mercury and an inert gas. Line voltage alone is usually insufficient to operate high voltage UV lamps and thus, a step-up transformer is often used. Other examples of high voltage and high intensity UV sources include high-pressure mercury lamps, mercury capillary lamps, and deep UV lamps. Often, UV sources emit not only UV light, but also visible light and wavelengths in the infrared spectrum. Accordingly, the selection of an appropriate UV lamp involves determining the output of the UV spectrum of each particular UV lamp to match the UV lamp with the particular curing conditions of the ink. Mercury lamps primarily emit radiation in the UV and far UV region and are preferred in UV curing.

Commercially available UV radiation sources include, but are not limited to, Fusion Model 300 from Fusion Systems Corp. of Rockville, Md., Honle Model UVA Print 740 (e.g., fitted with a Mercury bulb, a metal halide bulb or another bulb having an output wavelength from about 200 nm to about 450 nm) from Honle Corp. of Marlboro, MA and UVEXS® models designated as UVEXS® Model CCU, UVEXS® Model ECU, UVEXS® Model SAC, UVEXS® Model SACC, UVEXS® Model OCU, UVEXS® SCU and UVEXS Model 471, available from Ultraviolet Exposure Systems, Inc. of Sunnyvale, Calif.

Visible radiation sources that may be utilized in the radiation curing device are well known to the skilled artisan. Visible radiation sources include, but are not limited to, xenon lamps (e.g., xenon short arc lamps, water-cooled xenon lamps), halogen lamps, deuterium lamps, light emitting diodes, and metal-doped lamps (such as iron, gallium and lead-doped lamps).

Electron beam radiation sources include those disclosed in U.S. Pat. No. 5,968,605 (Lutz) and U.S. Pat. No. 6,500,495 (Lutz), each of which are incorporated herein by reference. The electron beam radiation is generated with the use of an electron beam source chamber (e.g., by an electron beam tube). A suitable low power electron beam generating apparatus is made by American International Technologies (AIT) of Torrance, Calif. and designated as the MIN-EB® CBT-101 model fitted with a ST-01-5050 model electron beam tube which requires minimal radiation shielding. See U.S. Reissue Pat. No. 35,203, incorporated herein by reference. Suitable radiation shielding materials include, but are not limited to, leaded acrylic, lead oxide epoxy, lead, other metals and leaded glass such as those available from Nuclear Associates of New York.

The electron beam tube is a vacuum tube having a base end and a window end. An extended filament is disposed within the beam tube proximate to the base end. The filament generates electrons in conjunction with electron beam forming electrodes. The electrons from the filament (i.e., electron beam source) are directed toward and through the beam window of the electron beam tube. A low power electron beam tube is preferred. The beam energy from a low power beam tube is below about 125 kV, typically between about 15-80 kV (or any value therebetween), more typically between about 20-75 kV and most typically between about 30-65 kV. The voltage to the power supply (input voltage from about 10 to about 1,000 volts) is preferably about 110 volts (or less) and its operating power is preferably about 100 watts (or less). However, the output voltage of the beam tube may be between 20-100 kV or any value therebetween. Likewise, the operating power of the electron beam may be from about 10-1,000 watts or any value therebetween.

The window of the low power beam tube should be sufficiently transparent to the low power electron beam to transmit sufficient energy to cure the logo ink or the production ink of the present invention. For example, the window should be sufficiently transparent to permit passage of sufficient electron-beam energy to cure a layer of a logo ink or a production ink on a golf ball or game ball.

Without being bound by theory, it is believed that curing using electron beam radiation is inhibited by oxygen. Thus, the use of electron beam radiation curing requires that the material to be cured be surrounded by a gas, for example, an inert gas (e.g., argon, helium) or nitrogen, or mixtures thereof during irradiation and cure. The method of the present invention initially cures the surface of the ink using UV radiation, and, therefore, eliminates the need for the use of an inert atmosphere. The method of the present invention thus eliminates problems associated with uncured ink due to oxygen inhibition, and is more cost-effective than standard electron beam curing applications due to there being no requirement to provide an inert atmosphere for curing.

In one embodiment of the invention the cooling gas is air. While in many instances it is preferred to use the UV, visible, or UV/visible curing step before the electron beam curing step, the use of the electron beam curing step before the UV, visible, or UV/visible curing step is also envisioned.

During electron beam curing, the electron beam causes the beam window temperature to rise. Thus, the beam window is preferably exposed to at least one of these gases at a flow rate sufficient to prevent cracking, breaking, overheating, melting or otherwise damaging the beam window (i.e., maintaining the integrity of the beam window). Typically, the gas flow over the window prevents rapid temperature increases (i.e., overheating) of the beam window. The gas flow rate should be sufficient to maintain the transparency and the integrity of the window. For example, nitrogen gas at a flow rate from about 0.5 to about 30 cubic feet per minute (CFM) or more is sufficient to maintain the integrity of the beam window during curing. Further, the irradiation time (i.e., residence time) is about 10 seconds or less, typically from about 0.1 seconds to about 10 seconds or any value therebetween. Preferably, the residence time is from about 300 millisecond (ms) to about 3 seconds and most preferably from about 500 ms-1.5 seconds. It is preferred to use a minimum residence time to maximize production.

Further, it is preferred that the electron beam has a beam width suitable to expose the ink surface to be cured. Preferably, the cure speed achievable with electron beam radiation is in the order of about 200 ft/second or less. The electron beam irradiation and curing may be accomplished with an array of electron beam tubes or with a single electron bean tube.

The radiation sources of the present invention can take on a variety of designs. In one embodiment, the radiation source is a point source where the radiation originates and is emitted from a single point. Thus in one embodiment, the conveyor and the orienter sufficiently positions the ball such that the radiation from the radiation source contacts the uncured ink on the surface of the ball to cure the uncured ink. The orienter can further rotate and orient the ball to cure any additional uncured ink layers or indicia located in other ball locations. The point source is preferably a single UV light source, a single visible light source, or a single electron beam radiation source.

Figure 6:
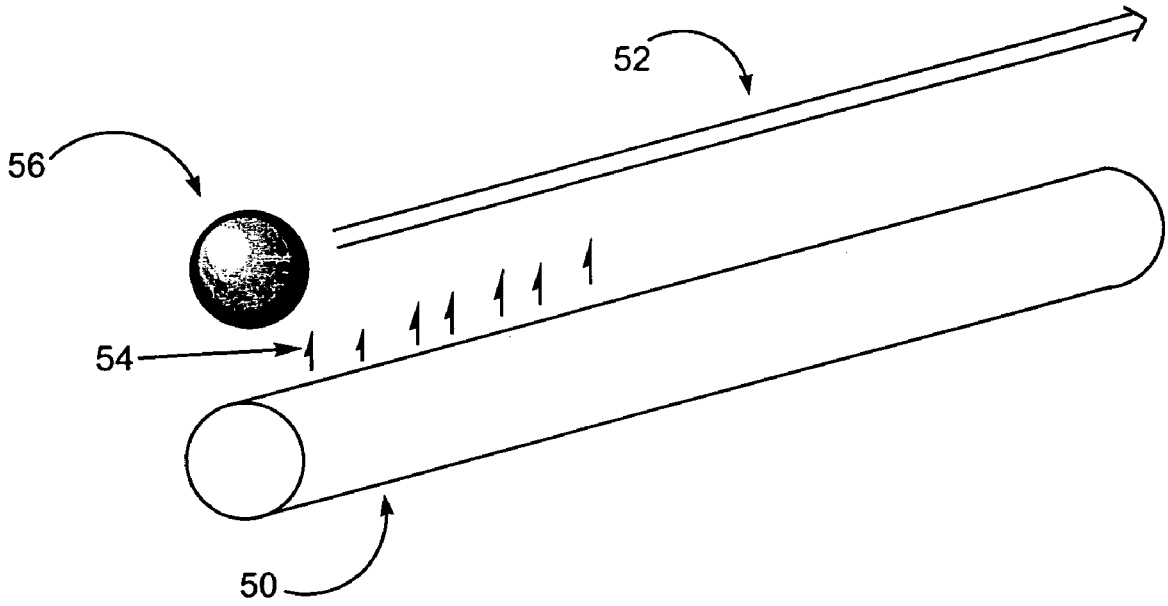
FIG. 6 shows a single longitudinal radiation source that cures ink on a ball as the ball travels through a curing station.

In another embodiment, the radiation source is a single longitudinal source 50, wherein the single longitudinal source is positioned longitudinally and parallel to the direction of ball conveyance 52, as seen in FIG. 6. Preferably, the single longitudinal source emits radiation 54 that is substantially perpendicular to the line of ball conveyance, which radiation contacts the ball 56 and particularly the uncured ink on the surface of the ball. Thus, a ball conveyed down a conveyor line has continuous contact with radiation from the single radiation source for at least a portion of path where the ball travels in the curing station. In one embodiment, two or more balls are conveyed down a conveyor line having continuous contact with radiation from the single radiation source for at least a portion of path where the two or more balls travel in the curing station. In yet another embodiment, the orienter or orienters sufficiently position the ball or two ore more balls such that the radiation from the single longitudinal source contacts the uncured ink on the surface of each ball to cure the uncured ink as it is conveyed through the curing station. The orienter can further rotate and orient each ball to cure any additional uncured ink layers or indicia located in other ball locations. In another embodiment, the orienter can rotate the ball as it is conveyed through the curing station. The rotation ensures sufficient curing of uncured ink. The single longitudinal source is preferably a single UV light source, a single visible light source, or a single electron beam radiation source.

Figure 7A:
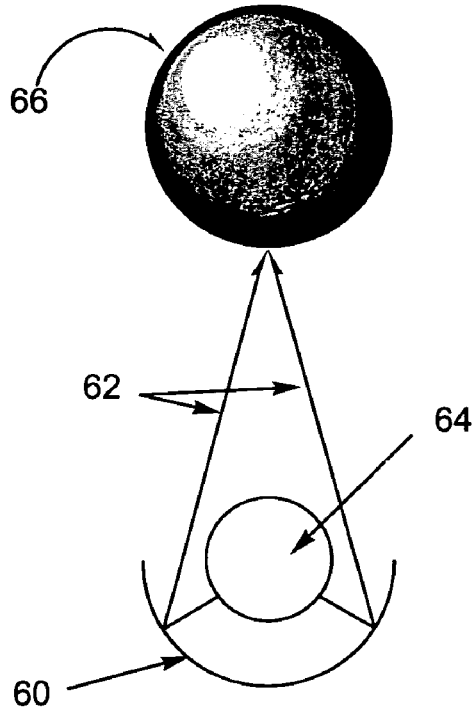
FIGS. 7A-7E show various shaped dichroic reflectors that control the incidental radiation that contacts the surface of the ball in the curing station.

In one embodiment, the radiation curing device includes one or more dichroic reflectors or cold mirrors; one or more cooling gases; or a combination thereof; sufficient to prevent overheating of ink layers, (e.g., production ink layers or logo ink layers), topcoats, overcoats and/or other parts of the substrate (e.g., golf ball), as well as the radiation lamp. The dichroic reflectors or cold mirrors control heat by only allowing the desirable UV and visible radiation to pass through while infrared radiation, i.e., heat, is filtered by reflecting away from the golf ball surface. Thus, the present invention encompasses the use of reflectors in conjunction with the radiation source to control the incidence of radiation contacting the surface of the ball in curing the ink(s). Preferably, the reflectors are dichroic reflectors. The reflectors can be of any construction and shape to provide controlled contact of radiation onto the surface of the ball. In one embodiment, the reflector 60 can have a parabolic shape that is capable of focusing radiation 62 emitted from the radiation source 64 on one spot of the ball 66, as shown in FIG. 7A. The parabolic shape is advantageous because focusing radiation on one spot of the ball decreases cure time.

Figure 7B:
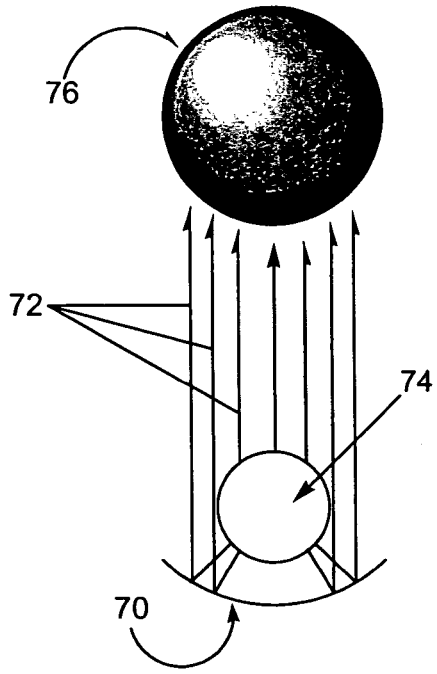
Figure 7C:
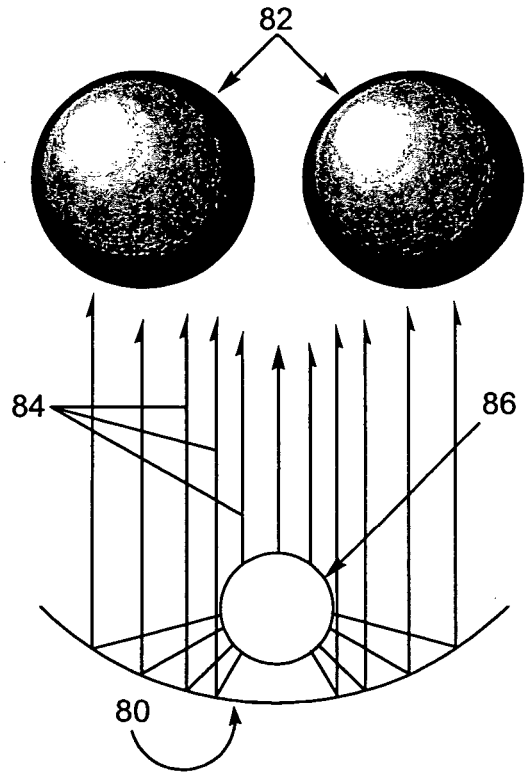

In another embodiment, the reflector 70 can have a partial elliptical shape that is capable of redirecting radiation 72 emitted from the radiation source 74 so that the reflected radiation is substantially parallel to each other, as shown in FIG. 7B. The elliptical shape is advantageous because the reflected radiation contacts a greater surface area of the ball 76 than direct radiation emitted only from the radiation source or reflected from a parabolic reflector. In one embodiment, the greater surface area of the radiation reflected from a partial elliptical-shaped reflector 80 sufficiently contacts the surface of two or more balls 82 that are simultaneously conveyed through the curing station, as shown in FIG. 7C. The reflector 80 is capable of redirecting radiation 84 emitted from the radiation source 86 so that the reflected radiation is substantially parallel to each other. Curing two or more balls simultaneously allows for higher throughput of balls having cured indicia.

Figure 7D:
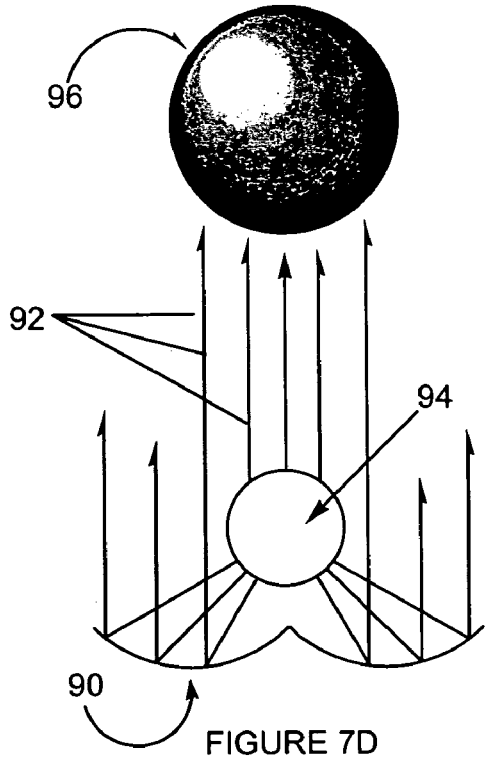
Figure 7E:
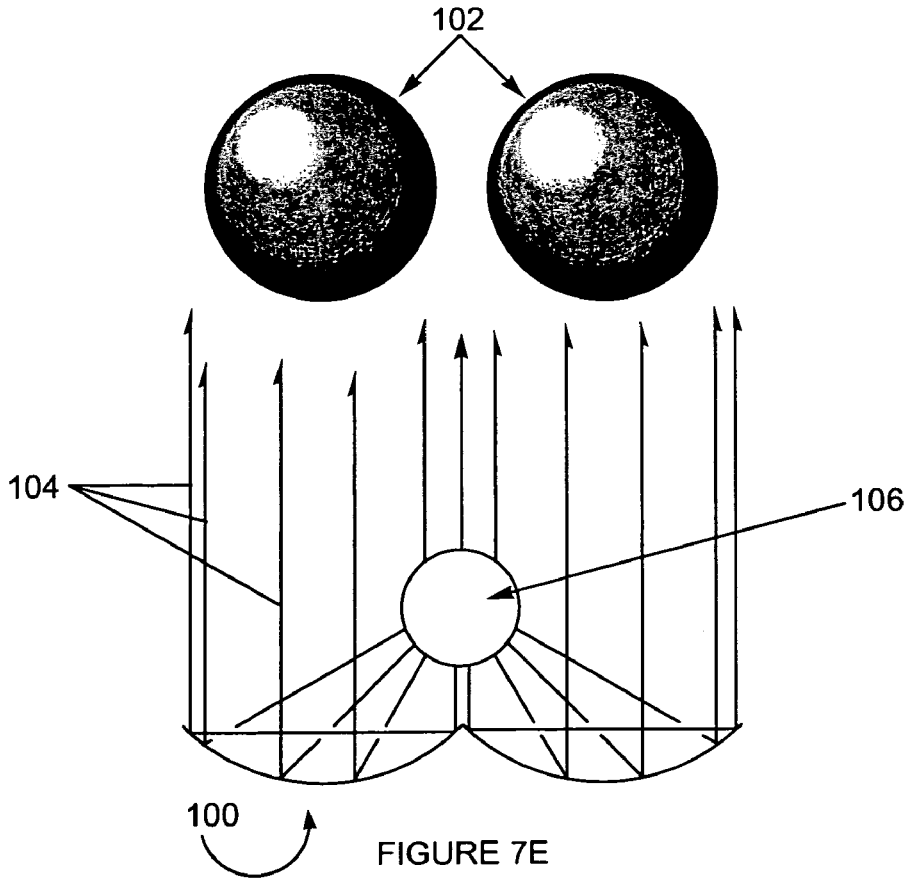

In yet another embodiment, the reflector 90 can have a dual parabolic or dual partial elliptical shape (i.e., in the shape of a "W") that is capable of redirecting radiation 92 emitted from the radiation source 94 so that the reflected radiation is substantially parallel to each other, as shown in FIG. 7D. The dual parabolic or dual partial elliptical shape is advantageous because the reflected radiation contacts a greater surface area of the ball 96 than direct radiation emitted only from the radiation source. In one embodiment, the greater surface area of the radiation reflected from a dual parabolic or dual partial elliptical-shaped reflector 100 sufficiently contacts the surface of two or more balls 102 that are simultaneously conveyed through the curing station, as shown in FIG. 7E. The reflector 100 is capable of redirecting radiation 104 emitted from the radiation source 106 so that the reflected radiation is substantially parallel to each other.

The cooling gases can be circulated by any means known to the skilled artisan, e.g., circulated by a cooling fan, to provide an envelope the substrate and to dissipate the heat. Gases should be non-reactive with the substrate, ink layers, topcoat, overcoat and/or other layers, especially during the exposure to radiation. Examples of suitable cooling gases include, but are not limited to, the inert gases (e.g., helium, argon, etc.), nitrogen, air or mixtures thereof. In a preferred embodiment, the cooling gases contain less than about 1 percent oxygen. Other suitable non-reactive, cooling gases are well known to one of ordinary skill in the art.

The invention also encompasses a method and apparatus for identifying, removing, cleaning and re-processing a golf ball pad printed with a curable ink that has a defective indicia. Once defective golf balls are identified by the vision inspection system prior to curing, they are rejected and transferred from the printing station to the ink removal or recycling station with the ink on the ball in its uncured state. Ink removal typically comprises exposing the golf ball having defective indicia to a cleaning agent that can at least partially dissolve the ink and may further include mechanical agitation of the ball to mechanically remove the ink from the surface. Cleaning agents include surfactants, bases, soaps and other cleaning agents well-known to one of ordinary skill in the art. The cleaning agent can contain an organic solvent or an aqueous solvent, and if miscible, a mixture thereof. In a preferred embodiment, the cleaning agent completely removes the ink.

In one embodiment, the golf balls subsequently are transferred to a cleaning station where they are processed through a rotary drum washer, sonic bath or agitated bath that uses a cleaning agent, including, but not limited to, NMP (N-methyl-2-pyrrolidone), alkaline-based aqueous cleaning agents, surfactants, or organic or non-aqueous solvents. The golf balls are removed from the washer, dried and reprocessed for printing. The golf balls can be air dried at room temperature, or dried at elevated temperatures (typically between about 80° F. to about 120° F.) for a time sufficient to evaporate substantially all of the cleaning solvent and/or water. This process can be used to remove ink from either the actual cover surface, such as unpainted SURLYN®, Balata, or other conventional cover compositions, or the finished ball surface, such as a topcoat or overcoat.

In another embodiment, the rotary drum washer can be sonically agitated and removes the ink via a plurality of high impact nozzles that spray the ball and immerse the ball in cleaning solution. In one embodiment, the cleaning solution can be heated to aid the removal of the ink from the ball surface.

The ink removal system also may be applied to any surface having pad-printed indicia that is defective, such as, for example, any type of ball (sports or toy balls), as well as surfaces having any type of polymeric, metal, stone, or synthetic material (e.g., plastic containers, pens, knives).

The present invention also encompasses a method of forming an inked image on a golf ball comprising the steps of: providing a golf ball, for example, by a ball delivery system; orienting the golf ball; transferring the golf ball to print station and placing at least one ink layer on at least a portion of the curved surface of the golf ball; transferring the golf ball having at least one ink layer to a vision inspection system/station; and obtaining an image of the at least one ink layer and analyzing the image to determine whether it is within acceptable parameters, including, but are not limited to, color (e.g., color type, color hue, color intensity, color brightness), image clarity, image placement, and image accuracy and precision (as compared to the intended image).

Once the ball is determined to be within acceptable parameters, the golf ball is transferred to a radiation curing station. At the radiation curing station, the at least one ink layer is cured by exposing the golf ball having the at least one ink layer to radiation selected from the group consisting of ultraviolet radiation, visible radiation, electron beam radiation and a combination thereof.

The at least one ink layer can be exposed to a first irradiation in an amount sufficient to at least partially cure a portion thereof, and exposing the at least one ink layer to a second irradiation in an amount sufficient to further cure the at least one ink layer. The first irradiation can comprise electron beam radiation and the second irradiation can comprise ultraviolet radiation, visible radiation, or a combination thereof. Preferably, the first irradiation comprises ultraviolet radiation, visible radiation, or a combination thereof and the second irradiation comprises electron beam radiation.

The method can further comprise the step of applying one or more additional ink layers or indicia on at least a portion of the golf ball; and radiation curing the one or more additional ink layers or indicia. Typically, the one or more additional inked layers or indicia is a logo or production print. In one embodiment, the step of applying one or more additional ink layers or indicia on at least a portion of the golf ball is performed prior to or after inspection of the first ink layer or indicia.

The one or more additional inks layer may be applied sequentially or concurrently with the first ink layer. In one embodiment, the ball orienter allows printing of more than one indicia at several locations on the surface of the ball as the golf ball is conveyed from a first ink transfer pad to a second ink transfer pad and optionally one or more additional ink transfer pads. Each time the ball is conveyed to an ink transfer pad, the ball is rotated on any axis for printing on another surface portion of the ball, preferably on another unprinted surface portion. The rotation is controlled and repeatable in order to inspect the indicia printing at the vision inspection system. The rotation ranges from about 1 to about 360 degrees, preferably from 10 degrees to about 320 degrees, more preferably from about 45 degrees to about 270 degrees and most preferably from about 90 degrees to about 180 degrees.

If the analyzed image is determined to be in nonconformance with production standards, the golf ball is transferred to an ink removal or recycling station. In the ink removal or recycling station, the golf ball and the at least one ink layer typically is exposed to a cleaning agent and mechanical agitation to remove the at least one ink layer. The ink removal or recycling station may be a rotary drum washer, and in particular, may be sonically agitated and further comprises high impact nozzles that spray the golf ball with the cleaning agent.

Figure 5:
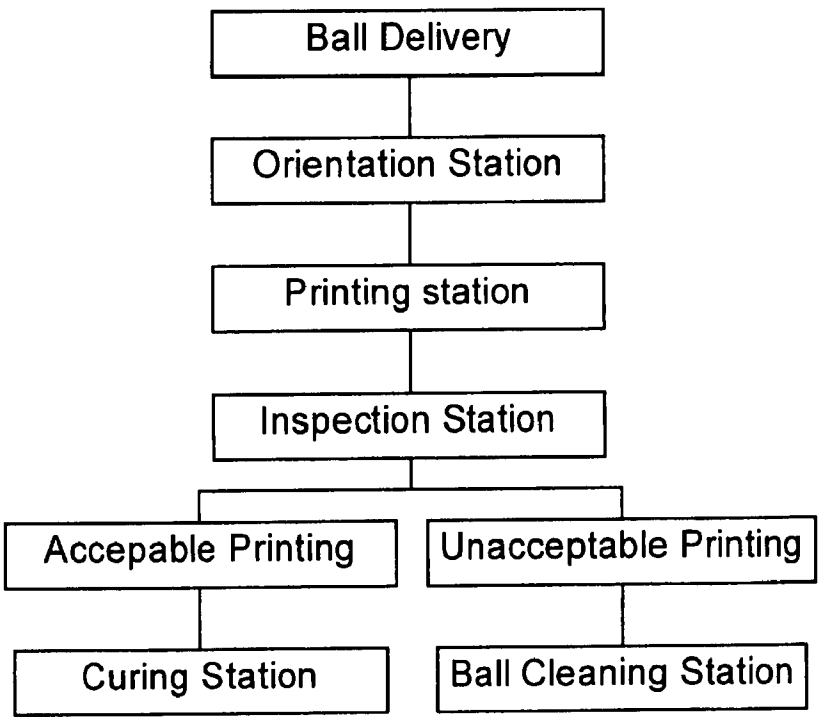
FIG. 5 is a diagram that depicts a game ball printing method.

FIG. 5 shows a diagram depicting the game ball printing method. First, a ball delivery apparatus provides balls first to a ball orientation station. After the ball is oriented into the desired orientation, it is transferred to a printing station where the surface of the ball is printed with an inked image. Once the inked image is printed, the ball is transferred to an inspection station. Golf balls having acceptable printed images are transferred to the curing station. Golf balls having unacceptable printed images are transferred to the ball cleaning station.

The following detailed description is provided to aid those skilled in the art in practicing the present invention. However, it should not be construed to unduly limit the scope of the present invention. Variations and modifications in the embodiments discussed below may be made by those of ordinary skill in the art without departing from the invention.

I claim:

1. A method of forming an inked image on a golf ball comprising the steps of:

providing at least one golf ball;

transferring the golf ball to a print station comprising a sealed cup assembly comprising:

a container comprising ink;

an impeller able of rotating the ink;

a motor connected to the impeller;

a means to monitor the current or amperage of the motor;

a solenoid valve operatively connected to the sealed cup assembly capable of supplying the sealed cup assembly with a viscosity-adjusting agent when the current or amperage of the motor does not meet a predetermined set point;

orienting the golf ball to receive one or more indicia, logo or production print, and placing at least one ink layer on at least a portion of a curved surface of the golf ball, wherein the step of orienting comprises rotating the golf ball about more than one axis to one or more desired orientations to receive one or more indicia, logo, or production print without substantially moving the center of the golf ball, wherein the step of placing at least one ink layer comprises dispersing the ink from the sealed cup assembly;

applying the ink to a pad to provide an inked pad;

contacting the curved surface with the inked pad comprising the indicia, logo, or production print;

transferring the golf ball having at least one ink layer of indicia, logo or production print to a vision inspection system;

obtaining an image of the at least one ink layer and analyzing the image to determine whether it is within predetermined acceptable parameters;

transferring the golf ball to an ink removal or recycling station after the analyzed image is determined to be in nonconformance with the predetermined acceptable parameters and removing the at least one ink layer of the nonconforming image or transferring the golf ball to a radiation curing station after the analyzed image is determined to be within the predetermined acceptable parameters followed by curing the at least one ink layer by exposing the golf ball to radiation.

2. The method of claim 1, wherein the at least one ink layer is cured by radiation selected from the group consisting of ultraviolet radiation, visible radiation, electron beam radiation and a combination thereof.

3. The method of claim 1, wherein the at least one ink layer is subjected to a first irradiation in an amount sufficient to at least partially cure a portion thereof, and subjecting the at least one ink layer to a second irradiation in an amount sufficient to further cure the at least one ink layer.

4. The method of claim 3, wherein the first irradiation comprises electron beam radiation and the second irradiation comprises ultraviolet radiation, visible radiation, or a combination thereof.

5. The method of claim 3, wherein the first irradiation comprises ultraviolet radiation, visible radiation, or a combination thereof and the second irradiation comprises electron beam radiation.

6. The meted of claim 1, further comprising the step of applying a second ink layer on at least the same or a different portion of the golf ball; and radiation curing the second ink layer.

7. The method of claim 6, wherein the second ink layer is applied before the golf ball is transferred to the vision inspection system.

8. The method of claim 1, wherein the step of contacting the curved surface with an inked pad comprising the indicia, logo, or production print comprises inking a pad with ink stored in the sealed cup assembly.

9. The method of claim 1, wherein the radiation curing station is cooled by one or more dichroic reflectors or cold mirrors; one or more cooling gases; or a combination thereof.

10. The method of claim 1, wherein the golf ball and the at least one inked image of the nonconforming image is contacted with a cleaning agent and subjected to mechanical agitation to remove the at least one ink layer of the nonconforming image.

11. The method of claim 1, wherein the ink removal or recycling station is a rotary drum washer.

12. The method of claim 11, wherein the rotary drum washer is agitated and further comprises high impact nozzles tat spray the golf ball with the cleaning agent.

13. The method of claim 12, where in the agitation is sonic agitation or mechanical agitation.

14. The method of claim 1, wherein the golf ball is maneuvered to position the at least one ink layer within view of at least one camera in the vision inspection system, and wherein the at least one ink layer is scanned and analyzed to determine whether the at least one ink layer is within the predetermined acceptable parameters.

15. The method of claim 14, wherein the at least one ink layer is analyzed for pixel content and compared to a reference image.

16. The method of claim 15, wherein the at least one ink layer is analyzed for placement within a predetermined area of the golf ball surface and compared to the placement of a reference image.

17. The method of claim 14, wherein the at least one ink layer is analyzed for color and image clarity and compared to a reference image.

18. The method of claim 1, wherein two or more golf balls are transferred to and conveyed through the curing station to simultaneously cure indicia on each ball.

19. The method of claim 3, wherein the curing station comprises a single longitudinal radiation source, wherein the single longitudinal radiation source is positioned longitudinally and parallel to the direction of golf ball conveyance;

the single longitudinal source emits radiation that is substantially perpendicular to the line of golf ball conveyance; and the ball has continuous contact with radiation from the single radiation source for at least a portion of path where the golf ball travels in the curing station.

20. The method of claim 1, wherein the one or more indicia, logo or production print is placed on an equator of the ball.

21. The method of claim 1, wherein the means to monitor the current or amperage of the motor operates continuously.

22. The method of claim 1, wherein the step of transferring a golf ball to a print station further comprises monitoring the viscosity of the ink in the sealed cup assembly and dosing a viscosity-reducing agent to the sealed cup assembly when the current or amperage of the motor exceeds the predetermined set point or dosing a viscosity-increasing agent when the current or amperage drops below the predetermined set point.

* * * * *